US006588067B2

(12) United States Patent
Efron et al.

(10) Patent No.: US 6,588,067 B2
(45) Date of Patent: Jul. 8, 2003

(54) CUFF LINKS WITH INTERCHANGEABLE INSERT MEMBERS AND COMPONENTS THEREOF

(76) Inventors: Daniel Efron, 7 Iselin Dr., New Rochelle, NY (US) 10804; Leonardo Efron, 400 56th St., Apt. No. 10F, New York, NY (US) 10022

( * ) Notice: Subject to any disclaimer, the term of this patent is extended or adjusted under 35 U.S.C. 154(b) by 0 days.

(21) Appl. No.: 09/867,164

(22) Filed: May 29, 2001

(65) Prior Publication Data

US 2002/0178549 A1 Dec. 5, 2002

(51) Int. Cl.[7] ..... A44B 1/04; A44B 5/00; A44C 13/00

(52) U.S. Cl. ..... 24/102 SL; 24/102 FC; 24/94; 24/114.9; 24/114.11

(58) Field of Search ..... 24/102 SL, 102 FC, 24/94, 114.9, 114.11

(56) References Cited

U.S. PATENT DOCUMENTS

| | | | | | |
|---|---|---|---|---|---|
| 558,349 | A | * | 4/1896 | Brunka | 24/102 SL |
| 639,094 | A | * | 12/1899 | Rohrbek | 14/102 SL |
| 1,362,402 | A | * | 12/1920 | Ehrenfeld | 24/94 |
| 2,013,465 | A | * | 9/1935 | Johnson | 24/94 |
| 2,544,876 | A | | 3/1951 | Bowder | |
| 2,860,395 | A | | 11/1958 | Anderson | |
| 3,439,439 | A | | 4/1969 | Stimson | |
| 3,535,747 | A | | 10/1970 | Benn | |
| 4,528,726 | A | | 7/1985 | Kurashima | |
| 4,566,155 | A | * | 1/1986 | Kurashima | 24/94 |
| 4,809,417 | A | * | 3/1989 | Normann, Jr. | 29/160.6 |

FOREIGN PATENT DOCUMENTS

| | | | | |
|---|---|---|---|---|
| DE | 0336847 | * | 5/1921 | 24/102 SL |
| FR | 2662058 | | 11/1991 | |
| GB | 0017911 | * | of 1896 | 24/102 SL |
| GB | 0001959 | * | of 1904 | 24/102 SL |
| GB | 0311338 | * | 5/1928 | 24/102 SL |
| JP | 10276806 | | 10/1998 | |

OTHER PUBLICATIONS

*JCK Magazine*, pp. cover page and 254–256, Jun. 2001.
Senior Editor Anthony Delharco, "Jewelry in the French Tradition," www.jckgroup.com, Jun. 1, 2001.

* cited by examiner

*Primary Examiner*—Victor Sakran
(74) *Attorney, Agent, or Firm*—H. T. Than Law Group

(57) ABSTRACT

The present invention is directed to a cuff link for attaching to a shirtsleeve. The cuff link includes a holder and at least one insert member. The insert member is relesably retained in the holder by a pivotal latch member of the holder. The insert member can include an insert of various materials such as gems or precious metals.

18 Claims, 2 Drawing Sheets

CUFF LINKS WITH INTERCHANGEABLE INSERT MEMBERS AND COMPONENTS THEREOF

FIELD OF THE INVENTION

The present invention relates to a cuff link, and more particularly to a cuff link with interchangeable insert members and the components of such cuff links.

BACKGROUND OF THE INVENTION

All conventional shirt cuffs fully encircle the wrist of the wearer so that they may be fastened. Shirts for men's use are largely classified into two types depending on the fastener used. In one type, the overlapped cuff ends are fastened usually by a button. In the other type, often called "French cuff", the overlapped cuff ends are fastened by a cuff link instead of a button. Some cuffs of the former type are made to be "convertible" so that, if desired, they may be fastened with a cuff link instead of a button.

Conventional shirt cuffs and cuff links often have a uniformity of appearance. Thus, someone who desires to change the look of their cuff links would need to have a number of sets of cuff links with various styles, which can be expensive.

Attempts have been made to solve this problem by providing cuff links with interchangeable parts. For example, JP Patent No.10276806 to Super Planning:KK discloses a cuff link with two different types of ornament pieces. The first piece includes a spring member rotatably connected to a holder for retaining a pattern part. The spring member is releasably connectable to a base A with the pattern part in the open position. Once the spring member is connected to the base, the pattern part covers a base plate. The second piece includes a holder for retaining a pattern part. The holder further includes projections that releasably connect the second piece by snapping the projections about a base plate.

Another example is disclosed in U.S. Pat. No. 3,535,747 to Benn. This patent discloses a cuff link, which in one embodiment, includes a head with a pivotal spring clip connected thereto. The spring clip is received in slot of the link post to secure the head to the post.

Although both of these patents disclose interchangeable cuff links these assemblies may be difficult or costly to manufacture or difficult to use. Therefore, there remains a need for an improved cuff link that has interchangeable members but is easy and inexpensive to manufacture and user friendly.

SUMMARY OF THE INVENTION

The present invention is directed to a cuff link comprising an insert member and a holder. The insert member includes an insert coupled to a catch member. The holder includes a base and a post. The base defines a slot for selectively receiving the catch member, and the base includes a latch member pivotally coupled thereto. The latch member cooperates with the catch member in a closed position to secure the insert member to the holder.

In one embodiment, the latch member is coupled to a bottom surface of the base.

According to one aspect of the present invention, the insert may be made from materials such as onyx, sterling silver, pearl, gold, platinum, bronze, sterling silver, a base material covered by another material, fabric, skins such a leather, wood, coins, precious gems, or simulated gems, among others. These materials can be of various colors.

According to one embodiment, the holder further includes a cup member with the base and a sidewall that extends upwardly from the base to define a cavity for receiving the insert member.

According to yet another embodiment, the insert member further includes a cup member with a base and a sidewall that extends upwardly from the base to define a cavity for receiving the insert.

According to one aspect of the present invention, the post may further include a toggle member rotatably connected to the post and rotatable between a first position and a second position.

Preferably, at least two insert members are provided for each cuff link. The first insert member has the first insert, and the second insert member has the second insert, wherein the first and second inserts have different material properties. In such a cuff link, the material properties may be based on color, material type, and material composition.

The present invention is also directed to a cuff link holder that can be sold separately from the insert members. The cuff link holder comprises base and a post. The base includes a latch member pivotally coupled thereto for cooperating with an insert member in a closed position to secure the insert member to the holder.

The present invention is also directed to an insert member that can be sold separately from the cuff link holder. These insert members can be sold in pairs, individually or in sets with any number of pairs of matching insert members. Each insert member comprises an insert and a cup member configured and designed to receive the insert.

According to one aspect of the present invention, the insert may be made from materials such as onyx, sterling silver, pearl, gold, platinum, bronze, sterling silver, a base material covered by another material, fabric, skins such a leather, wood, coins, precious gems, or simulated gems, among others. These materials can be of various colors.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
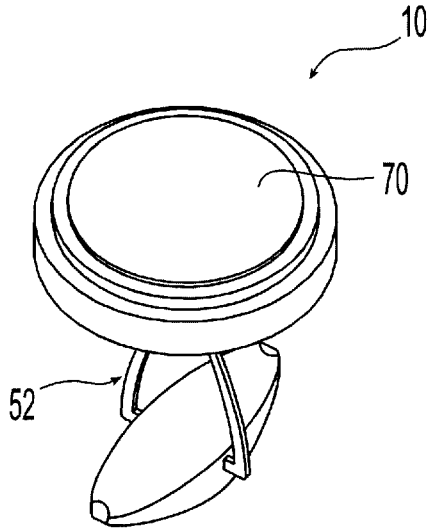
FIG. 1 is a perspective view of an assembled cuff link of the present invention.
Figure 2:
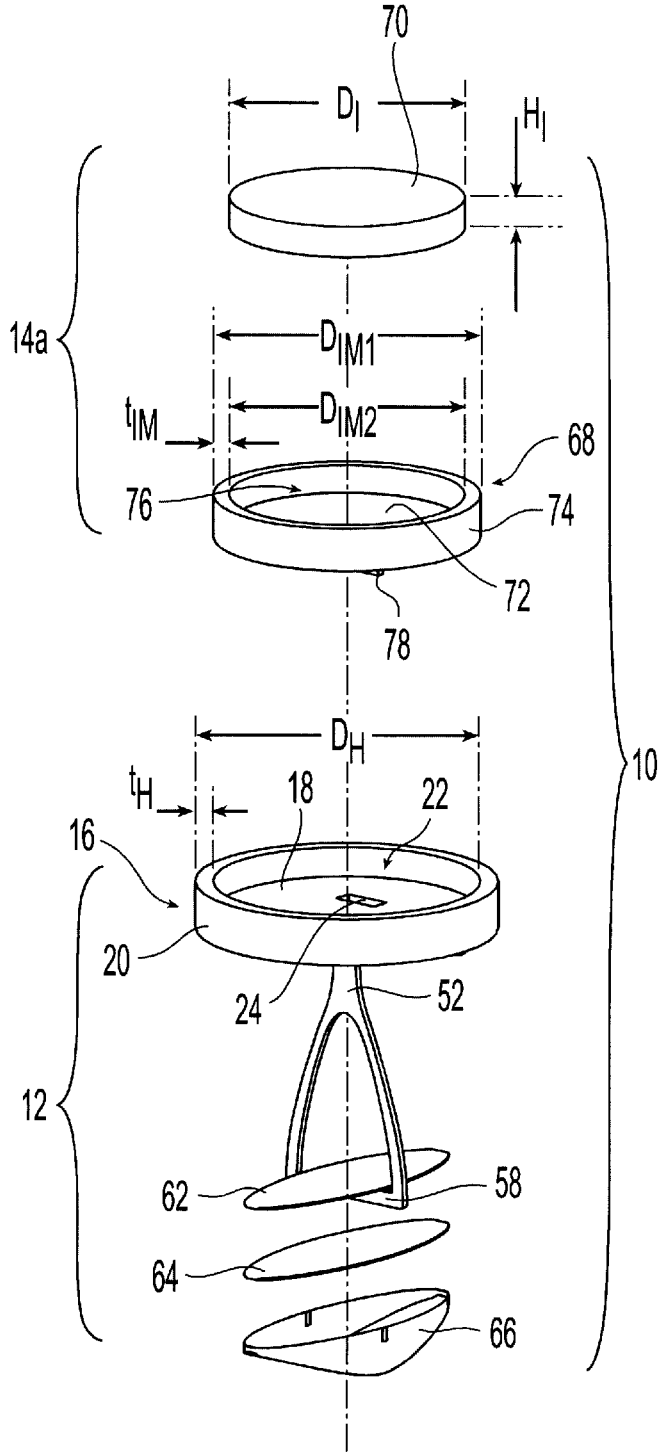
FIG. 2 is an exploded, perspective view of the cuff link of FIG. 1, wherein the cuff link is partially disassembled.

As shown generally in FIGS. 1–2 where like numbers designate like parts, reference number 10 broadly designates a cuff link of the present invention. The cuff link 10 includes a cuff link holder 12 and at least one insert member 14*a*.

Figure 3:
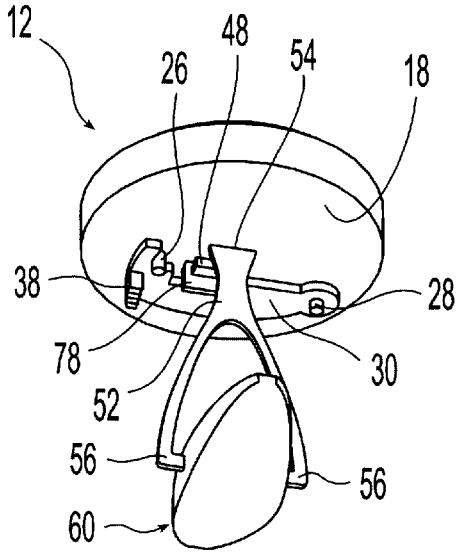
FIG. 3 is a bottom, perspective view of with the cuff link of FIG. 1, wherein a latch a member is in a closed position.
Figure 4:
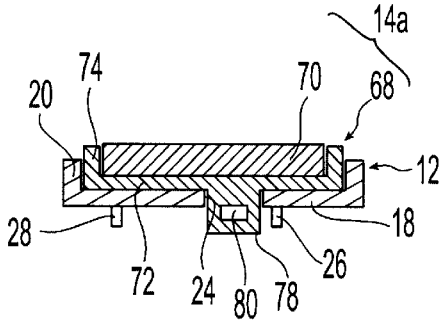
FIG. 4 is an enlarged, cross-sectional view of the cuff link of FIG. 1, with various portions such as a post and latch member removed for clarity.

The holder 12 includes a cup member 16 with a base 18 and an upwardly extending circular sidewall 20 thereabout. The sidewall 20 is optional. The base 18 and sidewall 20 are configured to define a cavity 22 within the cup member 16. The base 18 defines a rectangular slot 24 there through. Referring to FIGS. 3–4, the base 18 further includes two spaced apart posts 26 and 28 extending from the bottom surface thereof.

Referring to FIG. 2, the thickness of the sidewall 20 is designated by arrows labeled $t_H$ and the diameter of the cavity 22 is designated by arrows labeled $D_H$. In this embodiment, the preferred thickness $t_H$ of the sidewall 20 is between about 0.5 mm and about 2 mm. More preferably, the thickness $t_H$ of the sidewall 20 is about 1.0 mm. In this embodiment, the preferred diameter $D_H$ of the cavity 22 is between about 10 mm and about 20 mm. More preferably, diameter $D_H$ of the cavity 22 is about 16.5 mm.

In other embodiments, the cup member 16 can have various other shapes such as octagonal, trianglar, rectangular, or the sidewall 20 can be surrounded by various ornaments such as a simulated rope or numerous balls. In these embodiments, the dimensions of the cup member 16 may vary from the dimensions above.

Figure 5:
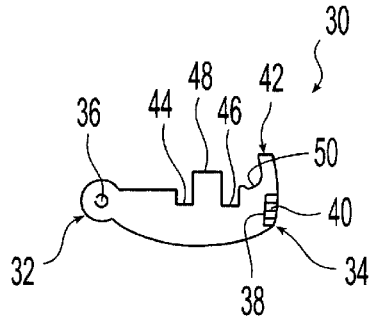
FIG. 5 is an enlarged, top view of the latch member shown in FIG. 3.

Referring to FIGS. 3–5, the holder 12 further includes a latch member 30 with a first end 32 and a second end 34. The first end 32 of the latch member 30 defines a bore 36 for receiving post 28. The latch member 30 and post 28 being configured and dimensioned to allow latch member 30 to pivot about post 28.

Referring again to FIGS. 3 and 5, the second end 34 of the latch member 30 includes an upwardly extending wall 38 for use by a user in moving the latch member 30. The free end of the wall in this embodiment includes serrations 40 for allowing a user's finger to move latch member 30. The second end 34 of the latch member 30 also includes a first projection 42, which may be used by a user in moving the latch member 30.

Figure 6:
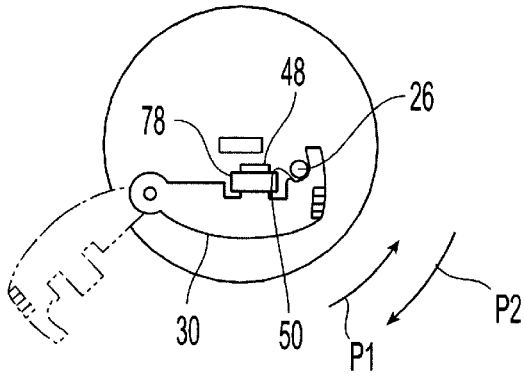
FIG. 6 is an enlarged, bottom view of the cuff link of FIG. 1 showing the latch member in the closed position in solid lines and in an open position in phantom lines.

Between the first end 32 and the second end 34, the latch member 30 further includes first and second cutouts 44 and 46 on opposite sides of a second projection 48, and a third cutout 50. As shown in FIG. 6, the third cutout 50 in conjunction with first projection 42 is configured and dimension to receive post 26 with a snap fit when the latch member 30 is in the closed position as shown. Referring again to FIG. 3, the holder 12 further includes an outwardly extending post 52. The post 52 is centrally disposed on the base 18. The slot 24 is eccentrically located on the base 18 so that it is spaced from the central post 52 (as shown in FIGS. 4 and 6). The post 52 is connected to the base 18 at a first end 54 and bifurcates toward the free ends 56. The free ends 56, however, are joined by a bar 58 (as shown in FIG. 2).

Referring to FIG. 3, the holder 12 further includes a toggle member 60. As shown in FIG. 2, the toggle member 60 includes first and second spring members 62 and 64 and a housing 66. When assembled, the bar 58 is sandwiched between the first and second spring members 62 and 64. The housing 66 receives the second spring member 64 therein and the ends of the housing 66 are bent to retain the spring members 62 and 64 therein. The components of the toggle member 60 are commercially available from various suppliers.

The bar 58, spring members 62, 64, and housing 66 are configured and dimensioned to allow the toggle member 60 to rotate between first and second positions. In the first position, the toggle member 60 is aligned with the post 52. In the second position (as shown in FIG. 3), the toggle member 60 is unaligned with the post 52. The components 58, 62, 64 and 66 are further configured and dimensioned so that when the toggle member 60 does not freely rotate between the first and second positions, and within an angle of about 15 degrees of the second position, the spring members 62 and 64 bias the toggle member 60 toward the second position.

In the first position of the toggle member 60, the cuff link holder can be inserted into a buttonhole of a shirt. In the second position of the toggle member 60, the cuff link holder is retained within the buttonhole.

Alternative arrangements and components, as know by those of ordinary skill in the art, can be used to allow the toggle member to operate as discussed above. For example, a swivel member can also be used that is commercially available.

Referring to FIG. 2, the holder 12 in this embodiment is formed of sterling silver, which has the necessary strength, finish and manufacturability characteristics desired. In other embodiments, the holder 12 can be formed of any other materials, such as gold, platinum, stainless steel, and the like that have the necessary characteristics. The holder can also be formed of a base material, such as stainless steel, and covered by techniques, such as electroplating with another metal. The coating metal can be, for example, gold, nickel, or silver.

The holder 12 is preferably produced by casting but it can be formed by other methods such as stamping or the die-stroke method. Referring to FIGS. 2 and 3, cup member 16 and latch member 30 are formed each as separate cast pieces. The cup member 16 and post 52 are joined together by methods such as soldering or welding and the like. The cup member is formed as a single piece with the base, sidewall, slot 24, and posts 26, 28. The post 52 is stamped with the bi-frication and bar 58 as one piece. The post 52 is a commercially available component. However, in another embodiment, these pieces can be formed differently and joined by methods such as soldering or welding and the like. After the latch member 30 is disposed on post 28, the free end of post 28 is formed into a wider-flattened shaped by riveting. This wider shape of the post end secures the latch member 30 thereto. The toggle member 60 is preferably formed about the bar 58 after the post 52 is coupled to the cup member 16.

Referring to FIG. 2, the insert member 14*a* includes a cup member 68 and an insert 70. Referring to FIGS. 2 and 4, the cup member 68 includes a base 72 and an upwardly extending circular sidewall 74 thereabout. The sidewall 74 is optional. The base 72 and sidewall 74 are configured to define a cavity 76 within the cup member 68. The base 72 further includes a catch member 78 extending from the bottom surface thereof. The catch member 78 defines a rectangular slot 80 there through. Referring to FIGS. 4 and 5, the slot 80 of the catch member 78 and the second projection 48 of the latch member 30 are configured and dimensioned so that the projection 48 can be received within the slot 80 to hold the insert member 14*a* in place.

Referring to FIG. 2, the outer diameter of the insert member 68 is designated by arrows labeled $D_{IM1}$ the diameter of the cavity 78 is designated by arrows labeled $D_{IM2}$, and the thickness of the sidewall 74 is designated by arrows labeled $t_{IM}$. In this embodiment, the preferred outer diameter $D_{IM1}$ of the insert member 68 is between about 12 mm and about 20 mm. More preferably, diameter $D_{IM1}$ is about 16.8 mm. In this embodiment, the preferred diameter $D_{IM2}$ of the cavity 78 is between about 10 mm and about 20 mm. More preferably, diameter $D_{IM1}$ of the cavity 78 is about 16.45 mm. In this embodiment, the preferred thickness $t_{IM}$ of the sidewall 74 is between about 0.5 mm and about 2 mm. More preferably, the thickness $t_{IM}$ of the sidewall 74 is about 1.0 mm. These dimensions are exemplary and the present invention is not limited thereto.

Referring to FIGS. 2 and 4, the insert 70 in this embodiment is a colored stone. The insert 70 is in the shape of a disk. The height of the insert 70 is designated by arrows labeled $H_I$ and the diameter of the insert 70 is designated by arrows labeled $D_I$. In this embodiment, the preferred height $H_I$ of the insert 70 is between about 1.5 mm and about 2.5 mm. More preferably, the height $H_I$ of the insert 70 is about 2 mm. In this embodiment, the preferred diameter $D_I$ of the insert 70 is between about 12 mm and about 20 mm. More preferably, diameter $D_I$ of the insert 70 is about 15 mm. These inserts are commercially available from Zarlene located in Fort Lauderdale, Fla. under the name onyx.

In this embodiment, the clearance between the insert 70 and the cup member 68 allow a press fit between these components to retain the insert 70 within the cavity 76. However, in another embodiment, the insert 70 can be glued or bonded to the cup member 68. For example an adhesive, such as epoxy, can be used.

In this embodiment, the height $H_I$ of the insert 70 and the depth of the cavity 76 in cup member 68 are such that the top surface of the insert is above the top surface of the sidewall 74. The present invention is not limited to this configuration and these dimensions can be varied so that the insert is flush with or below the top surface of the sidewall 74.

Furthermore, as shown in FIG. 4, the depth of the holder 12 cup member and the height of the insert member 14*a* are such that the cup member 68 and insert 70 are above the height of the holder 12 sidewall 20. The present invention is not limited to this configuration and these dimensions can be varied so that the insert member and/or insert are flush with or below the top surface of the sidewall 20.

The insert cup member 68 in this embodiment is preferably formed of sterling silver, which has the necessary strength, finish and manufacturability characteristics desired. In other embodiments, the insert cup member 68 can be formed of any other materials, similar to those discussed above for the holder 12.

Referring to FIG. 4, the insert cup member 68 is preferably made by casting, but it can be formed by other methods such as stamping or the die-stroke method. The catch member 78 is preferably formed with the cup member 68 as one piece. However in another embodiment, these pieces can be formed separately and joined by methods such as soldering or welding and the like. In this embodiment, the slot 80 is formed into the catch member 78 during casting of the cup member 68.

Figure 7:
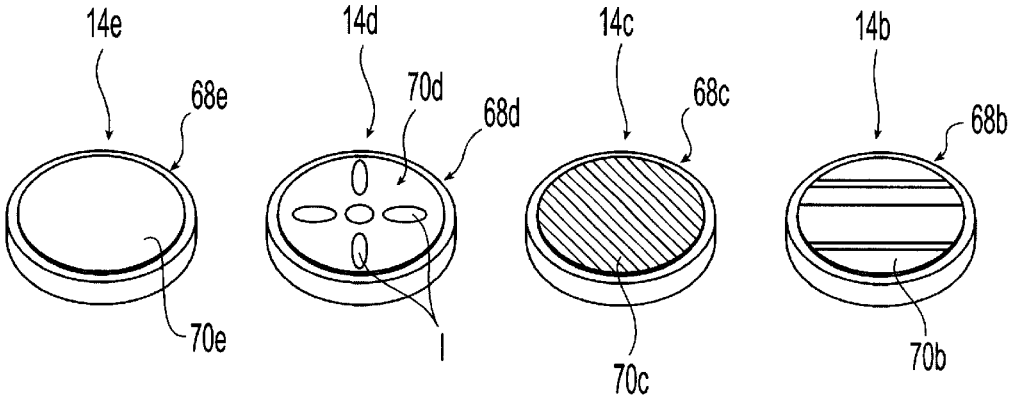
FIG. 7 is a top, perspective view of a set of various insert members for use with the cuff link of FIG. 1.

Referring to FIG. 7, various insert members 14*b–e* can be formed and used with the holder 12 (as shown in FIG. 2). The insert member 14*b–e* are formed similarly to insert member 14*a*. The insert member 14*b* includes for example a brown tiger's eye insert 70*b* in a sterling silver cup member 68*b*. The insert member 14*c* includes a black onyx insert 70*c* in a sterling silver cup member 68*b*. The insert member 14*d* includes a blue onyx insert 70*d* with indicia I thereon in a gold cup member 68*d*. The indicia I in this embodiment, is a geometric pattern. In other embodiments, however, the indicia can be any pattern, symbol, alphanumeric character or the like. The indicia can be formed by precious gems, gold leaf, silver leaf, paint, printing or the like. The insert member 14*e* includes a sterling silver insert 70*e* in a sterling silver cup member 68*e*.

In alternative embodiments, the insert can be formed of various other minerals, gems and/or metals such as diamonds, rubies, sapphire, turquoise, opal, mother-of-pearl, gold, platinum or bronze, sterling silver, a base material covered by another material, fabric, skins such a leather, wood, coins, precious gems, or simulated gems, among others. These materials can have various colors. An example of a fabric that can be used is a woven wool that may or may not match the material of a user's suit. The fabric may form at least the upper surface of the insert. Other fabrics that are woven or non-woven can also be used. These materials can have various colors.

Moreover, the cuff link can be provided with at least two insert members. The first insert member having a first insert, and the second insert member having a second insert. The first and second inserts may have different material properties. The material properties can be selected based on color, material type, texture, and material composition, among others.

Referring to FIGS. 3 and 7, a user is supplied with at least two cuff link holders 12 and at least two insert members 14*a–e*. Preferably, the insert members 14*a–e* are provided in matching pairs and additional pairs of matching insert members can be purchased as the user desires. As shown in FIGS. 4 and 6, with the latch member 30 in an open position as shown in phantom, the user takes one insert member, such as insert member 14*a*, and places it within the cavity 22 (as shown in FIG. 2) of the holder cup member 20 so that the catch member 78 is disposed within the slot 24 in the cup member 20. The user then pivots the latch member 30, as shown by arrow P1 in a first direction, from the opened position (shown in phantom) to the closed position (shown in solid). In a closed position, the second projection 48 of the latch member 30 extends through the slot 80 (as shown in FIG. 4) of the insert member 14*a* to retain the insert member 14*a* to the holder 12. The third cutout 50 receives the post 26 to secure the latch member 30 in the closed position. To change the insert member, the user pivots the latch member 30, as shown by arrow P2 in a second opposite direction, from the closed position to the opened position (shown in phantom). In the open position, the second projection 48 of the latch member 30 is spaced from the slot 80 (as shown in FIG. 4) of the insert member 14*a* to allow the insert member 14*a* to be removed from the holder 12. The user can then select another insert member, such as insert members 14*b–e*, as shown in FIG. 7, and secure the selected one in the holder as discussed above.

While various descriptions of the present invention are described above, it is understood that the various features of the present invention can be used singly or in combination thereof. Furthermore, in the present invention, the holder cup member, insert cup member and insert are all circular. In an alternative embodiment, these components can have various shapes such as rectangular, oval, and the like. In addition, the insert, insert cup member and holder cup member can have different shapes from one another so long as they are configured to cooperate together as discussed above. The sidewalls on insert and holder cup members are optional. Therefore this invention is not to be limited to the specifically preferred embodiments depicted therein.

What is claimed is:

1. A cufflink comprising:

a rigid insert member including an insert coupled to a catch member; and a holder including a base and a post, the base defining a slot far selectively receiving the catch member and the base including a latch member pivotally coupled thereto for cooperating with the catch member in a closed position to secure the insert member to the holder.

2. The cuff link of claim 1, wherein the latch member is coupled to a bottom surface of the base.

3. The cuff link of claim 1, wherein the insert is formed of a material selected from the group consisting of: brown onyx, black onyx, blue marbleized material, sterling silver, pearl, gold, platinum, bronze, sterling silver, a base material covered by another material, and precious gems.

4. The cuff link of claim 1, wherein the holder further includes a cup member with the base and a sidewall extending upwardly from the base to define a cavity for receiving the insert member.

5. The cuff link of claim 1, wherein the insert member further includes a cup member with a base and a sidewall extending upwardly from the base to define a cavity for receiving the insert.

6. The cuff link of claim 1, wherein the post further includes a toggle member rotatably connected to the post and rotatable between a first position and a second position.

7. The cuff link of claim 1, wherein the post is centrally disposed on the base.

8. The cufflink of claim 1, wherein the slot is eccentrically located on the base.

9. The cufflink of claim 2, wherein the holder further includes at least one additional post for rotatably supporting the latch member.

10. The cufflink of claim 9, wherein the holder further includes a second additional post and the latch member includes a cutout for cooperating with the second additional post when the latch member is in the closed position to releaseably retain the latch member in the closed position.

11. The cuff link of claim 1, wherein at least two insert members are provided, and the first insert member has the first insert, and the second insert member has the second insert, wherein the first and second inserts have different material properties.

12. The cuff link of claim 11, wherein the material properties are selected from the group consisting of color, material type, and material composition.

13. A cufflink comprising:

an insert member including an insert coupled to a catch member, and a holder including a base and a post, the base defining a slot for selectively receiving the catch member and the base including a latch member pivotally coupled thereto for cooperating with the catch member in a closed position to secure the insert member to the holder, wherein the holder further includes a cup member with the base and a sidewall extending upwardly from the base to define a cavity for receiving the insert member.

14. A cufflink comprising:

an insert member including an insert coupled to a catch member; and a holder including a base and a post, the base defining a slot for selectively receiving the catch member and the base including a latch member pivotally coupled thereto for cooperating with the catch member in a closed position to secure the insert member to the holder, wherein the insert member further includes a cup member with a base and a sidewall extending upwardly from the base to define a cavity for receiving the insert.

15. A cufflink comprising:

an insert member including an insert coupled to a catch member; and a holder including a base and a post, the base defining a slot for selectively receiving the catch member and the base including a latch member pivotally coupled thereto for cooperating with the catch member in a closed position to secure the insert member to the holder, wherein the post further includes a toggle member rotatably connected to the post and rotatable between a first position and a second position.

16. A cuff link comprising:

an insert member including an insert coupled to a catch member; and a holder including a base and a post, the base defining a slot for selectively receiving the catch member and the base including a latch member pivotally coupled thereto for cooperating with the catch member in a closed position to secure the insert member to the holder, wherein the latch member is coupled to a bottom surface of the base, wherein the holder further includes at least one additional post for rotatably supporting the latch member, and wherein the holder further includes a second additional post and the latch member includes a cutout for cooperating wit the second additional post when the latch member is in the closed position to releaseably retain the latch member in the closed position.

17. A cufflink comprising:

an insert member including an insert coupled to a catch member; and a holder including a base and a post, the base defining a slot for selectively receiving the catch member and the base including a latch member pivotally coupled thereto for cooperating with the catch member in a closed position to secure the insert member to the holder, wherein at least two insert members are provided, and the first insert member has the first insert, and the second insert member has the second insert, wherein the first and second inserts have different material properties.

18. The cufflink of claim 17, wherein the material properties are selected from the group consisting of color, material type, and material composition.

* * * * *